US006213694B1

(12) United States Patent
Ichikawa

(10) Patent No.: US 6,213,694 B1
(45) Date of Patent: Apr. 10, 2001

(54) DEVICE FOR REPAIRING METAL-STAMPING DIES

(75) Inventor: Toyohiko Ichikawa, Aichi-ken (JP)

(73) Assignee: Teikuro Corporation, Hayward, CA (US)

( * ) Notice: Subject to any disclaimer, the term of this patent is extended or adjusted under 35 U.S.C. 154(b) by 0 days.

(21) Appl. No.: 09/251,128

(22) Filed: Feb. 16, 1999

(51) Int. Cl.[7] ..... B23C 1/20

(52) U.S. Cl. ..... 409/139; 409/175; 409/181; 409/204; 451/352; 451/358

(58) Field of Search ..... 409/138, 139, 409/181, 182, 204, 206, 214, 175; 451/358, 352, 121, 439

(56) References Cited

U.S. PATENT DOCUMENTS 1,321,847 * 11/1919 Pond ..... 451/358
1,363,312 * 12/1920 Clarke ..... 451/358
1,374,604 * 4/1921 Peters ..... 72/199
1,775,430 * 9/1930 Hibbs ..... 144/117.4
2,069,700 * 2/1937 Emmons ..... 51/170
2,166,861 * 7/1939 Draheim ..... 51/170
2,925,644 * 2/1960 Barggren ..... 29/76
2,987,971 * 6/1961 Watson ..... 90/12
3,793,782 * 2/1974 Bowling ..... 51/170
3,841,030 * 10/1974 Laszlo ..... 51/170
3,914,905 * 10/1975 Waters ..... 51/170
3,984,946 * 10/1976 Waters ..... 51/170
4,693,648 * 9/1987 Cavedo ..... 409/178
4,805,349 * 2/1989 Demetrius et al. ..... 51/170
5,575,271 * 11/1996 Chiuminatta et al. ..... 125/13.01

* cited by examiner

*Primary Examiner*—Daniel W. Howell
(74) *Attorney, Agent, or Firm*—Christie, Parker & Hale, LLP

(57) ABSTRACT

A metal mold repair tool is provided for leveling the work surface of stamping dies used in metal forming operations. The repair tool includes a pair of guides disposed on opposite lateral sides of a rotary finisher to precisely position the finisher with respect to the work surface. The rotary finisher is preferably driven by a conventional drive motor. The finisher and guides are vertically displaceable relative to each other, such that the position of the finisher relative to the work surface can be adjusted as desired.

24 Claims, 6 Drawing Sheets

DEVICE FOR REPAIRING METAL-STAMPING DIES

BACKGROUND OF THE INVENTION

1. Field of the Invention

The present invention relates to surface finishing tools and, more particularly, to a rotary power tool for refinishing the surface of metal stamping dies.

2. Discussion of the Related Art

Metal mold presses are used to stamp flat sheet metal into various desired shapes. For example, the automobile assembly operation uses metal mold presses to form automobile body parts. Metal mold presses include one or more stamping dies which are made of metal and have a predetermined shape to impart a desired shape to the sheet metal. The surfaces of the stamping dies are often chrome-plated such that they are quite hard. However, over time stamping dies can crack or dent, which causes the sheet metal stamped by the dies to have a corresponding flaw. Thus, the stamping dies must be repaired or replaced. Repairing the stamping dies is the preferred remedy, due to the costs involved.

In an effort to cut costs, some automobile manufacturers have using to use relatively thin sheet metal for their automobile parts. As a result, maintenance of the stamping dies is now even more important, as imperfections will cause readily visible surface irregularities in the formed parts.

One conventional method for repairing these dies is to use a compound oil which fills in the imperfections on the surface of the die. However, in the case of chrome-plated dies, this method is ineffective because the lubricity of chrome is incompatible with compound oil. Thus, such a method has only limited applicability, and is not a long-term solution to the problem in any event.

Another method is to fill in the holes or cracks by welding, and then grind the surface of the dies smooth to restore the original surface contour. The conventional method of doing this is to use a hand grinder or a file to remove the welding material until it is flush with the surrounding die material. It is critical that too much of the welding material is not removed, or else the surface will again be uneven, and the process will have to be repeated. Such a method is extremely tedious, difficult, and time-consuming, especially when done with the naked eye. Even an experienced worker requires a significant amount of time to properly repair a stamping die by this method, causing a depth production while the die is being repaired.

Others have proposed motorized surface abrading machines that include cylindrical cutters, grinders or abraders which are vertically adjustable relative to a work surface in order to control the amount of material removed. For example, see U.S. Pat. Nos. 915,746, 2,069,700, and 2,166,861. While such devices constitute an improvement over the prior art methods mentioned above, they do not provide an adjustable multi-point support capable of reliably controlling the placement of the cutter, grinder, or abrader relative to the work surface.

In particular, the device disclosed in U.S. Pat. No. 2,069,700 to Emmons has significant shortcomings for use in finishing stamping dies which have had a filler such as welding material applied to a crack or dent. For example, the device includes an adjustable stop positioned in front of the rotary cutter, and a roller directly behind the cutter. Thus, as the tool is advanced, the forwardly disposed stop slides over the raised segment defined by the welding material and raises the cutter up off of the work surface, such that the work surface is not properly finished.

Accordingly, it will be apparent that there continues to be a need for a metal mold repair tool for repairing metal stamping dies that includes an adjustable assembly for reliably positioning a finishing member relative to the work surface as the tool is advanced across the work surface. The present invention addresses this need.

SUMMARY OF THE INVENTION

Briefly, and in general terms, the present invention is directed to a metal mold repair tool for smoothing the work surface of stamping dies used in metal molds. The repair tool includes a pair of stops or guides disposed on opposite lateral sides of a rotary finisher to precisely position the finisher with respect to the work surface. The rotary finisher is preferably driven by a conventional drive motor. The finisher and guides are vertically displaceable relative to each other, such that the position of the finisher relative to the work surface can be adjusted as desired.

Thus, in one illustrative embodiment, the present invention is directed to an apparatus for repairing metal stamping dies comprising: a housing; a rotary finisher rotatably mounted on the housing; a drive assembly mounted on the housing, coupled to the rotary finisher, and operative to rotate the rotary finisher; and a pair of guides disposed on opposite lateral sides of the rotary finisher, wherein the guides and rotary finisher are displaceable relative to each other to alter the relative positions of the guides and rotary finisher.

In another illustrative embodiment, the present invention is directed to a repair tool for stamping dies, including: a housing; a rotary finisher rotatably and adjustably mounted on the housing; a drive assembly mounted on the housing, coupled to the rotary finisher, and operative to rotate the rotary finisher; and a pair of guides disposed on opposite lateral sides of the rotary finisher Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENTS

Figure 1:
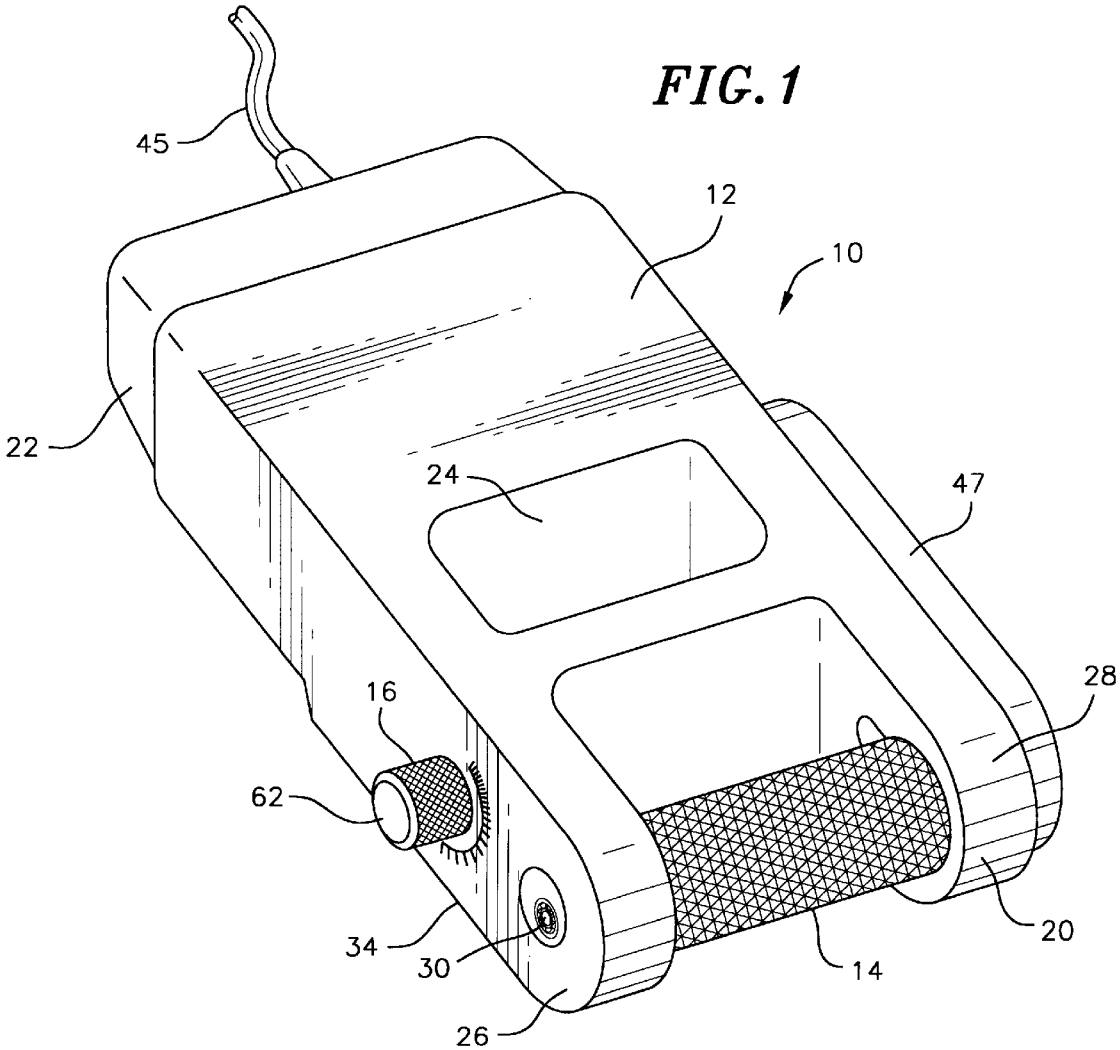
FIG. 1 is a perspective view of a metal mold repair tool depicting one illustrative embodiment of the present invention.
Figure 2:
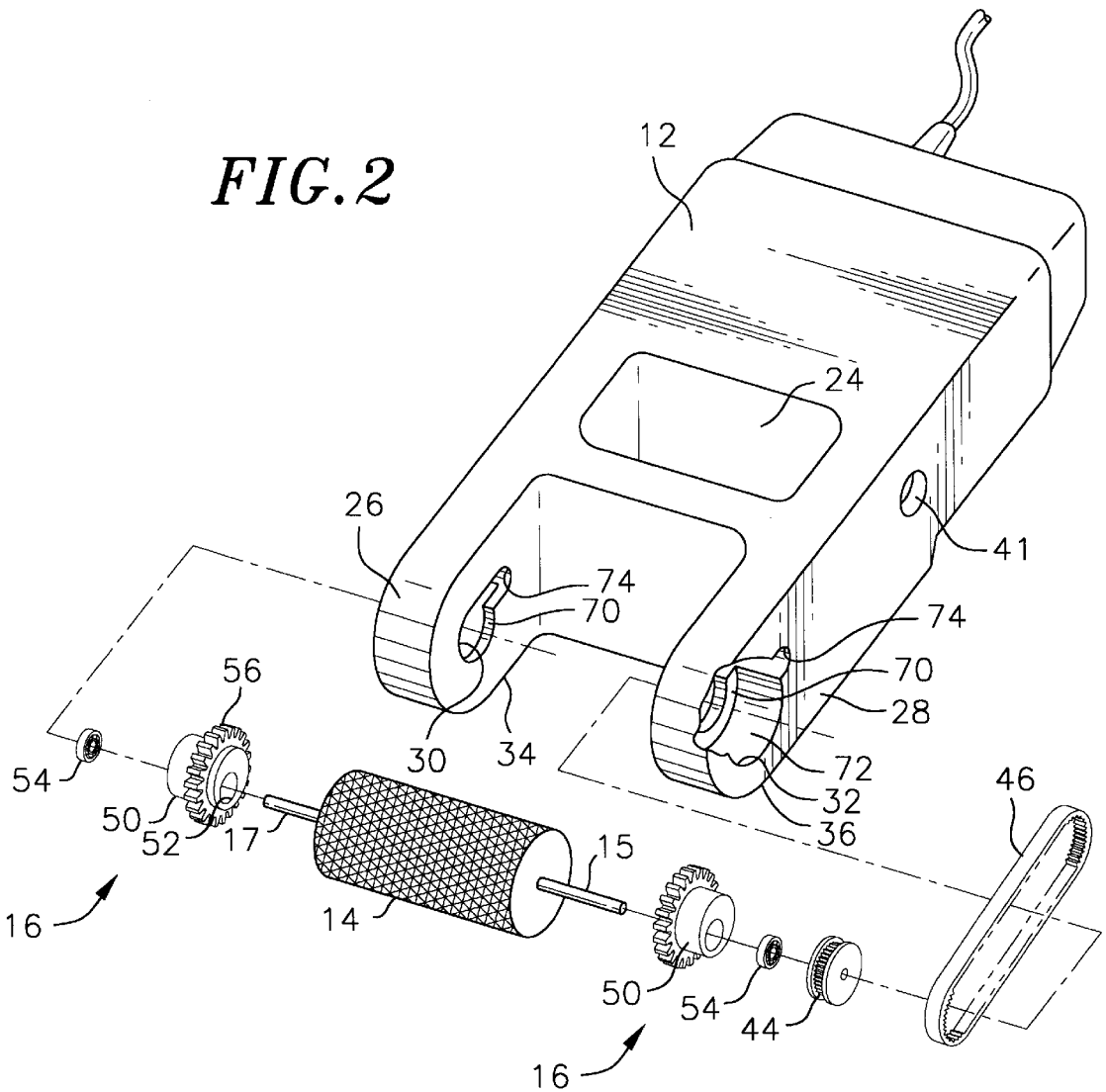
FIG. 2 is an exploded perspective view of the metal mold repair tool of FIG. 1.
Figure 3:
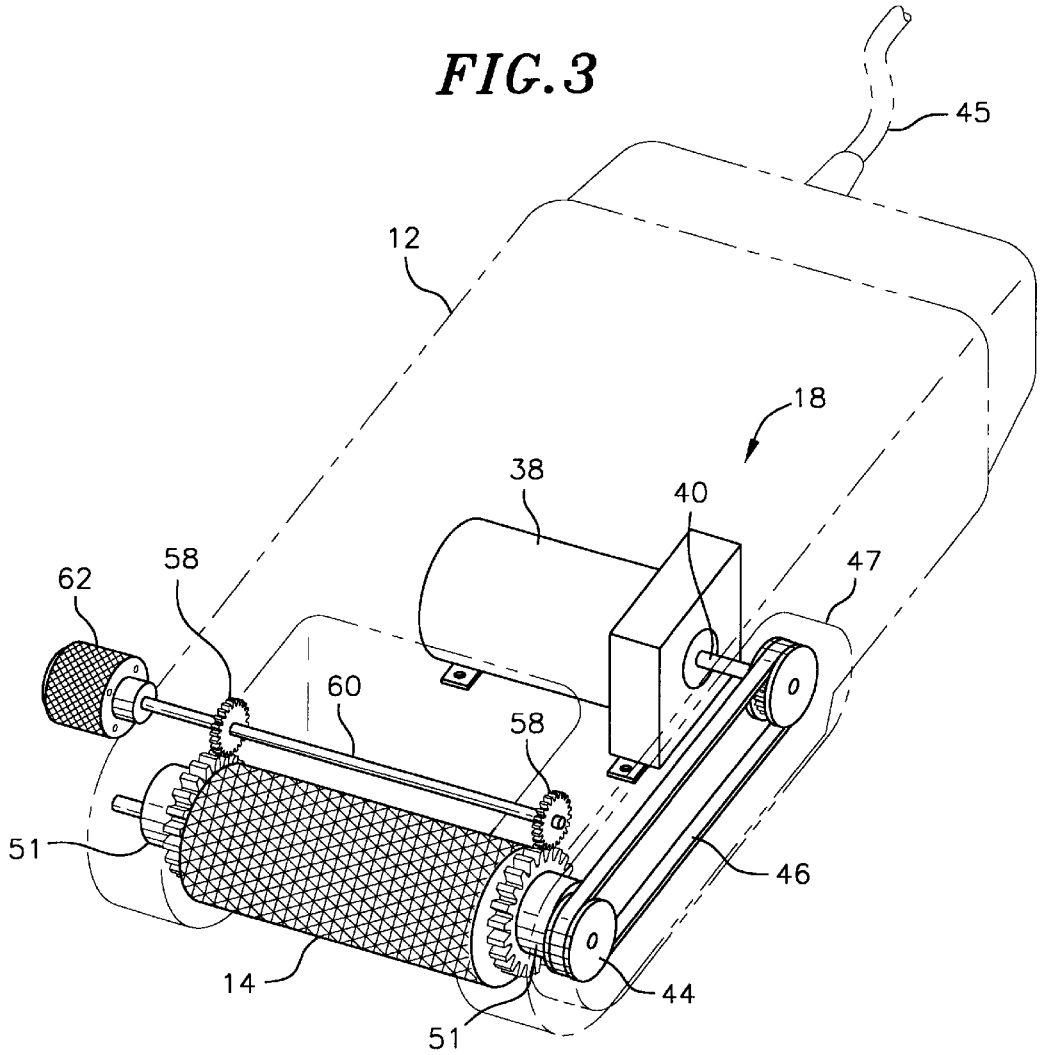
FIG. 3 is a perspective view, in enlarged scale and in partial phantom, of the metal mold repair tool of FIG. 1.
Figure 4:
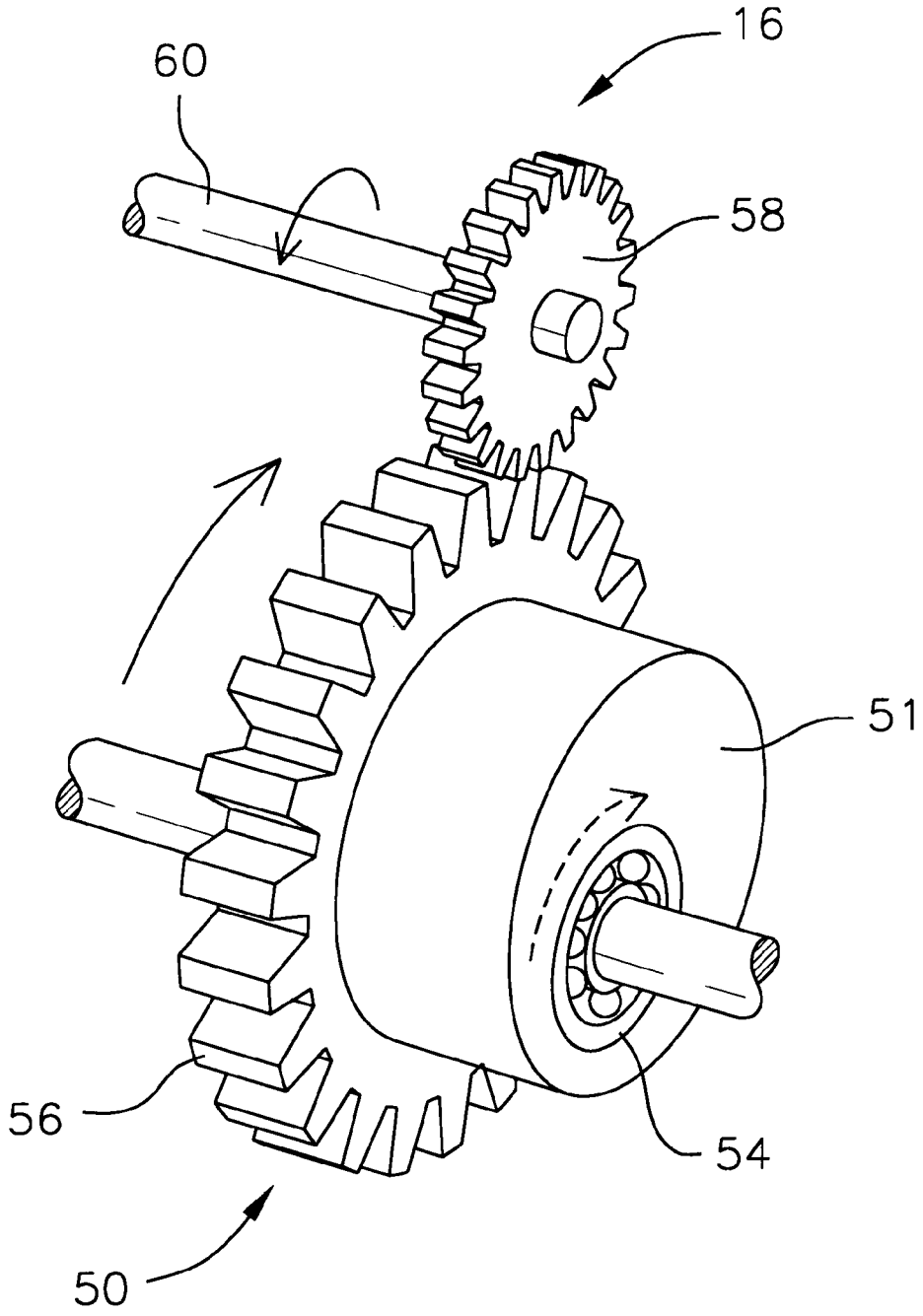
FIG. 4 is a fragmented, perspective view of components included in the metal mold repair tool of FIG. 1.

In the following detailed description, like reference numerals will be used to refer to like or corresponding elements in the different figures of the drawings. Referring now to FIGS. 1 and 3, there is shown a metal mold repair tool 10 according to one illustrative embodiment of the present invention. The tool 10 comprises, generally, a housing 12, a rotary finisher 14 rotatably mounted on the housing adjacent the front end thereof, an adjustment assembly 16 mounted on the housing 12 and engaged to the rotary finisher for altering the position of the rotary finisher relative to the housing, and a drive assembly 18 connected to the housing, engaged with the rotary finisher, and operative to rotate the finisher (FIG. 3). The tool may be used to finish surfaces of metal stamping dies, with the height of the rotary finisher 14 being adjustable relative to the housing 12 to accurately and reliably control the amount of material that is removed from a surface of a metal stamping die 19.

Figure 5:
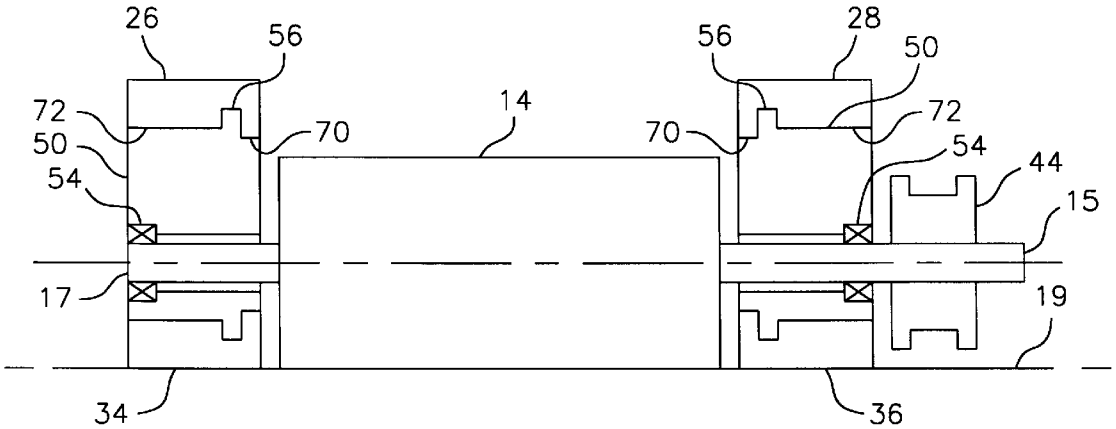
FIG. 5 is a cross-sectional front view of the metal mold repair tool of FIG. 1 showing a rotary finisher in a lowered position with respect to a work surface.
Figure 6:
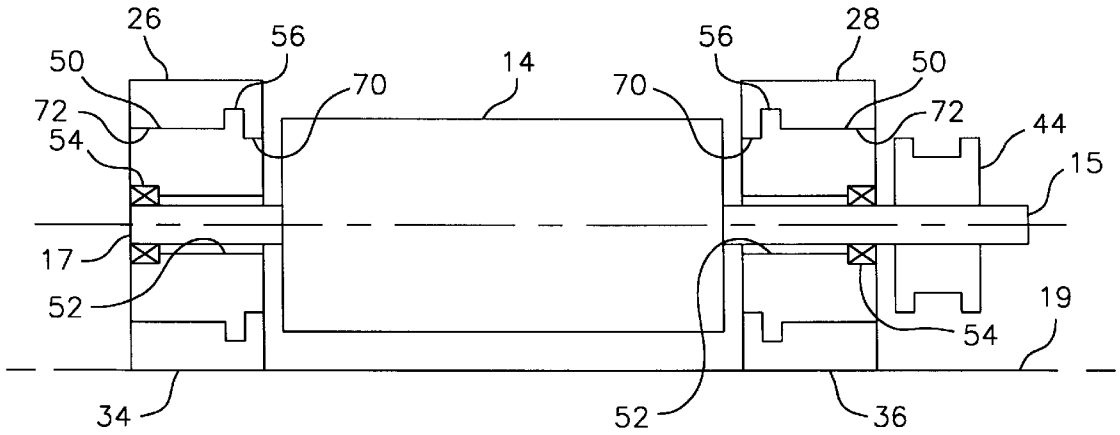
FIG. 6 is a cross-sectional front view similar to FIG. 5 and showing the rotary finisher in a raised position with respect to the work surface.

The housing 12 is elongated to define a hand-held housing with a forward longitudinal end 20 and a rear longitudinal end 22. The housing further defines an interior chamber 24 which houses a portion of the drive assembly 18 therein. The housing defines, at the forward end 20, a pair of opposing, forwardly projecting arms 26 and 28. The respective arms include lateral through bores 30 and 32 to receive a portion of the adjustment assembly 16, as described in greater detail below. The bottom ends of the respective arms extend below the bottom of the housing to define a pair of elongated stops or guides 34 and 36. With the tool 10 laid flat against a work surface 19, it will be apparent that the guides contact the work surface and the remainder of the housing is elevated above the work surface (FIGS. 5 and 6).

The rotary finisher 14 is rotatably mounted on the housing 12 adjacent the forward end 20 thereof, with the respective arms 26 and 28 flanking it on either side. The rotary finisher is preferably cylindrical, and can take many different forms, such as a cutter, grinder, abrader, and the like, each of which will have a suitable surface for performing a particular function. The finisher may also assume other shapes to create complementary contoured surfaces in the work surface, as is described in greater detail below in connection with FIG. 7. A pair of drive shafts 15 and 17 extend outwardly from the opposite longitudinal ends of the finisher for engagement with the adjustment assembly 16.

The drive assembly 18 includes an electric drive motor 38 and drive shaft 40 (FIG. 3), a first pulley 42 engaged to the drive shaft for rotation therewith and located outside of the housing 12, and a second pulley 44 disposed adjacent the forward end 20 of the housing alongside one of the arms 26. The drive shaft 40 extends through an opening 41 formed in the side wall of the housing 12 and is press fit into a central opening formed in the first pulley 42. The drive motor is powered by an electric cord 45 which terminates in a conventional plug (not shown) for insertion in an electrical outlet. A drive belt 46 runs over the first and second pulleys to transmit rotation of the first pulley to the second pulley. The drive motor is connected to the housing 12 and is housed in the interior chamber 24. Thus, the drive motor, drive shaft, and the first pulley are disposed at fixed locations relative to the housing 12. The second pulley, however, is not directly mounted to the housing, and therefore may be displaced relative to the housing 12 as a result of influence from the adjustment assembly 16, as described in greater detail below. The pulleys are preferably housed in a suitable cover 47 (FIG. 1) that is releasably connected to the housing 12. Alternatively, the cover may be integral with the housing.

While in the illustrative embodiment the tool 10 comprises an electrically powered drive motor 38, it will be apparent that the tool can be powered by pressurized air or by any other well-known means. Thus, the illustrative embodiment is merely an example of one illustrative embodiment of the present invention.

The adjustment assembly 16 is provided to allow a user of the tool 10 to adjust the position of the rotary finisher 14 relative to the housing 12 and thus to the guides 34 and 36. The adjustment assembly comprises a pair of eccentric drives 50 disposed on either side of the rotary finisher 14. The respective eccentric drives are generally cylindrical and include eccentrically disposed through bores 52 through which the respective rotary finisher drive shafts 15 and 17 extend. The eccentric drives also include bearings 54 sized for press fitting insertion into the respective through bores 52, the bearings including inner races sized to engage the respective drive shafts 15 and 17. Thus, the drive shafts are journaled in the eccentric drives, such that the rotary finisher 14 may rotate with respect to the eccentric drives 50. One of the drive shafts 15 passes through the respective bearing and is press fit into a central opening formed in the second pulley 44. Thus, the second pulley is carried by the drive shaft 15. That drive shaft is preferably made longer than the other drive shaft 17 for extension through the pulley 44 in addition to the eccentric drive 50.

Preferably, the through bores 52 in the eccentric drives 50 are formed at predetermined locations thereon such that the rotary finisher 14 can only be lowered to a position in which its lower end is aligned with the bottom ends of the guides 34 and 36. Therefore, the finisher can not be lowered to a position below that of the guides, and thus can not remove material below the plane of the work surface.

The bearings 54 may take many different forms, and preferably comprise ball bearing assemblies with inner and outer races and plural balls which ride in a track defined between the respective races. Other bearings, such as roller bearings, may also be used.

The eccentric drives 50 include first and second cylindrical portions 55 which flank respective annular arrays of teeth 56 formed generally centrally thereon, the teeth defining a central gear portion of the eccentric drives and which are engaged by respective pinions 58 mounted on a rotatable adjustment shaft 60. The adjustment shaft extends through an opening in the side wall of the housing 12 and terminates in a knurled adjustment knob 62 disposed outside of the housing. Thus, rotation of the adjustment knob causes the adjustment shaft, pinions, and the eccentric drives to rotate. Because the drive shafts 15 and 17 of the rotary finisher 14 pass through the eccentric drives at a location offset from the center of those drives, rotation of the eccentric drives causes the rotary finisher to be displaced vertically relative to the housing 12. Thus, the adjustment assembly is operative to adjust the position of the rotary finisher relative to the housing. Because the drive shaft 15 carries the second pulley 44, vertical displacement of the rotary finisher results in vertical displacement of the second pulley as well.

The through bores 30 and 32 each include reduced-diameter segments 70 and enlarged segments 72, with the segments 70 receiving the first cylindrical portions 55 of the eccentric drives 50, and the segments 72 receiving the enlarged gear portions 56 and second cylindrical portions of the eccentric drives 50. Respective recesses 74 lead rearwardly and upwardly from the enlarged segments 72 to receive the respective pinions 58 which mesh with the respective gear portions 56 of the eccentric drives 50.

Because the eccentric drives 50 must be able to rotate relative to the housing 12, the through bore segments 70 and 72 are sized to loosely receive the respective cylindrical portions 55 of the eccentric drives.

The tool 10 may also include additional guides formed generally centrally on the bottom of the housing 12 at a location rearward of the rotary finisher 14. The additional guides extend downwardly to the same extent as the first and second guides 34 and 36, to provide a stable multi-point contact with the working surface 19.

Figure 7:
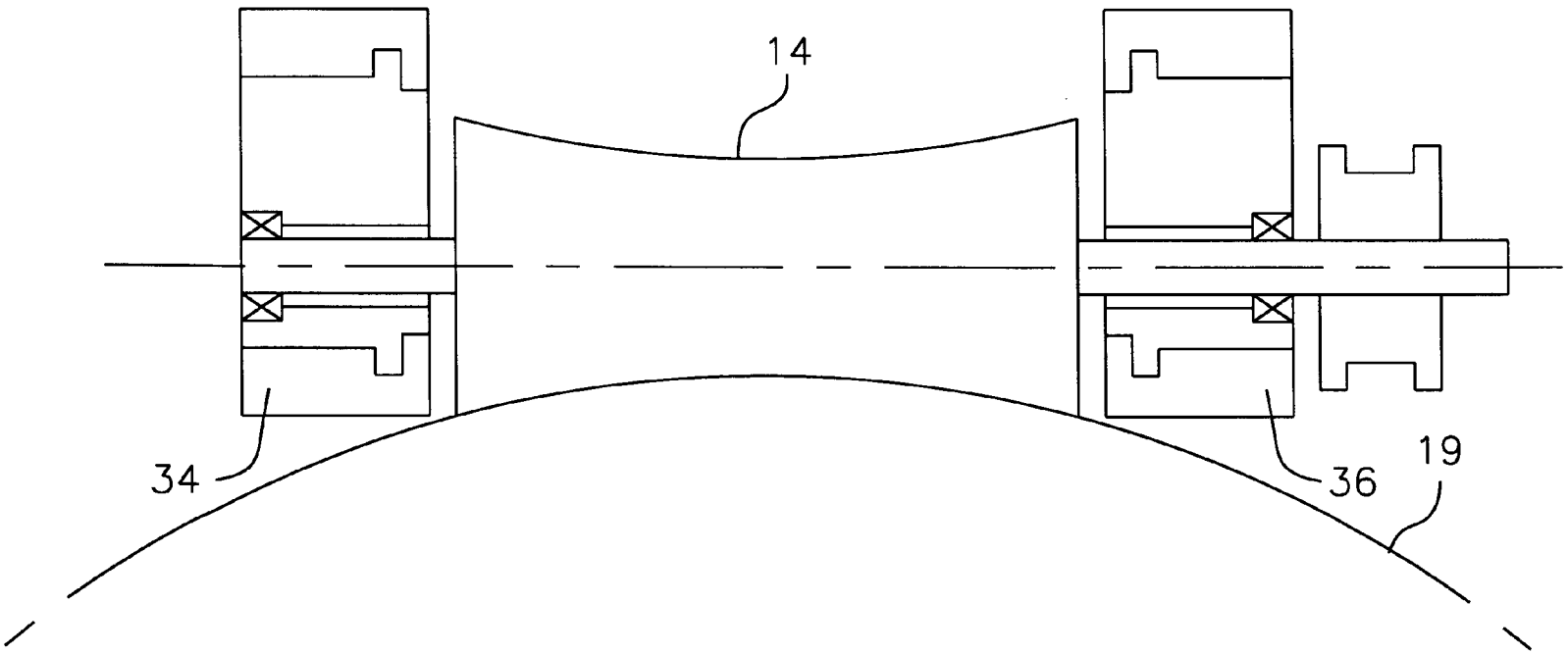
FIG. 7 is a cross-sectional front view similar to FIG. 5 and showing another illustrative embodiment of the metal mold repair tool of the present invention.

In addition, while the bottom of the finisher 14 and the guides 34 and 36 are shown in the illustrative embodiment as being flat for finishing a flat stamping die, it will be apparent that the bottom of the finisher and of the guides can assume a different contour to match that of the surface being finished. For example, as shown in FIG. 7, the finisher 14 can be formed with a concave surface, such that the guides and finisher define a generally semi-circular contour to complement a curved work surface.

In use, a worker may hold the tool 10 in his or her hand and connect the tool to an appropriate power source, such as an electrical outlet or source of pressurized air. In the illustrative embodiment, the tool includes the drive motor 38, and actuation of the drive motor, for example by flipping a switch (not shown) mounted on the housing, causes the drive motor to rotate the shaft 40, which translates into rotation of the first and second pulleys 42 and 44. This causes the rotary finisher 14 to rotate, and the tool can then be placed against a work surface of a stamping die 19, with the guides 34 and 36 abutting the work surface and the rotary finisher 14 disposed at a selected height relative to the work surface as dictated by the adjustment assembly 16 and guides 34 and 36. The tool is then advanced across the work surface, with the finisher smoothing the work surface.

If the height of the rotary finisher 14 requires adjustment, the user may simply rotate the adjustment knob 62 to control the adjustment assembly 16 and thereby selectively raise and lower the finisher relative to the housing 12 and guides 34 and 36. It will be understood that rotating the knob in one direction causes the finisher to initially be lowered, and that if the user continues to rotate the knob in the same direction, the finisher is raised relative to the housing due to the eccentric drives 50. Once the rotary finisher 14 is adjusted to the proper height relative to the guides 34 and 36, the tool may be placed on the work surface and advanced across the surface to grind away a portion of the surface as dictated by the height of the finisher.

From the foregoing, it will be apparent that the metal mold repair tool 10 of the present invention provides an efficient, reliable, and adjustable tool for smoothing a working surface of a stamping die or the like.

While forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. An apparatus for repairing metal stamping dies, the apparatus comprising:

a housing;

a rotary finisher rotatably mounted on the housing;

a drive assembly mounted on the housing, coupled to the rotary finisher, and operative to rotate the rotary finisher; and a pair of guides disposed on opposite lateral sides of the rotary finisher, wherein the guides and rotary finisher are displaceable relative to each other to alter the relative positions of the guides and rotary finisher.

2. The apparatus of claim 1, wherein the housing defines a forward end and a rearward end, and the rotary finisher is disposed adjacent the forward end of the housing.

3. The apparatus of claim 1, wherein the rotary finisher is adjustably mounted on the housing.

4. The apparatus of claim 1, wherein the guides are formed integral with the housing.

5. The apparatus of claim 1 further including a guide formed on the housing rearwardly of the rotary finisher.

6. The apparatus of claim 1, wherein the rotary finisher comprises one of a cutter, grinder, and abrader.

7. The apparatus of claim 3 further including an adjustment assembly connected to the housing and to the rotary finisher, the adjustment assembly being operative to displace the rotary finisher relative to the housing.

8. The apparatus of claim 7, wherein the adjustment assembly comprises a pair of eccentric drives, and the rotary finisher comprises a pair of shafts journaled in the respective eccentric drives for rotation relative to the eccentric drives.

9. The apparatus of claim 8, wherein the eccentric drives include toothed peripheral portions, and the adjustment assembly comprises an adjustment shaft and pinions meshed with the respective toothed peripheral portions, whereby rotation of the adjustment shaft is translated into rotation of the eccentric drives to displace the rotary finisher relative to the housing.

10. An apparatus for repairing metal stamping dies, the apparatus comprising:

a housing;

a rotary finisher rotatably and adjustably mounted on the housing for movement with the housing along a preselected path;

a pair of guides disposed on opposite lateral sides of the rotary finisher at locations outside the preselected path of the rotary finisher;

an adjustment assembly operative to displace the rotary finisher relative to the guide; and, a drive assembly mounted on the housing, coupled to the rotary finisher, and operative to rotate the rotary finisher.

a pair of guides disposed on opposite lateral sides of the rotary finisher at locations outside the preselected path of the rotary finisher.

11. The apparatus of claim 10, wherein the housing defines a forward end and a rearward end, and the rotary finisher is disposed adjacent the forward end of the housing.

12. The apparatus of claim 10, wherein the guides are formed integral with the housing.

13. The apparatus of claim 10 further including a guide formed on the housing rearwardly of the rotary finisher.

14. The apparatus of claim 10, wherein the rotary finisher comprises one of a cutter, grinder, and abrader.

15. An apparatus for repairing metal stamping dies, the apparatus comprising:

a housing;

a rotary finisher rotatably and adjustable mounted on the housing;

a drive assembly mounted on the housing, coupled to the rotary finisher, and operative to rotate the rotary finisher;

a pair of guides disposed on opposite lateral sides of the rotary finisher; and an adjustment assembly connected to the housing and to the rotary finisher, the adjustment assembly being operative to displace the rotary finisher relative to the housing.

16. The apparatus of claim 15, wherein the adjustment assembly comprises a pair of eccentric drives, and the rotary finisher comprises a pair of shafts journaled in the respective eccentric drives for rotation relative to the eccentric drives.

17. The apparatus of claim 16, wherein the eccentric drives include toothed peripheral portions, and the adjustment assembly comprises an adjustment shaft and pinions meshed with the respective toothed peripheral portions, whereby rotation of the adjustment shaft is translated into rotation of the eccentric drives to displace the rotary finisher relative to the housing.

18. An apparatus for repairing metal stamping dies, the apparatus comprising:

an elongated housing;

a rotary finisher rotatably mounted on the housing;

a drive assembly mounted on the housing, coupled to the rotary finisher, and operative to rotate the rotary finisher;

an adjustment assembly connected to the housing and to the rotary finisher, the adjustment assembly being operative to displace the rotary finisher relative to the housing; and a pair of guides disposed on opposite lateral sides of the rotary finisher.

19. The apparatus of claim 18, wherein the housing defines a forward end and a rearward end, and the rotary finisher is disposed adjacent the forward end of the housing.

20. The apparatus of claim 18, wherein the guides are formed integral with the housing.

21. The apparatus of claim 18 further including a guide formed on the housing rearwardly of the rotary finisher.

22. The apparatus of claim 18, wherein the rotary finisher comprises one of a cutter, grinder, and abrader.

23. The apparatus of claim 18, wherein the adjustment assembly comprises a pair of eccentric drives, and the rotary finisher comprises a pair of shafts journaled in the respective eccentric drives for rotation relative to the eccentric drives.

24. The apparatus of claim 23, wherein the eccentric drives include toothed peripheral portions, and the adjustment assembly comprises an adjustment shaft and pinions meshed with the respective toothed peripheral portions, whereby rotation of the adjustment shaft is translated into rotation of the eccentric drives to displace the rotary finisher relative to the housing.

* * * * *